United States Patent [19]

Lancelot, III

[11] Patent Number: 4,619,096

[45] Date of Patent: Oct. 28, 1986

[54] REBAR SPLICING AND ANCHORING

[75] Inventor: Harry B. Lancelot, III, Hurst, Tex.

[73] Assignee: Richmond Screw Anchor Co., Inc., Richland Hills, Tex.

[21] Appl. No.: 225,206

[22] Filed: Jan. 15, 1981

[51] Int. Cl.[4] ..... E04C 3/30

[52] U.S. Cl. ..... 52/726; 52/600; 52/739

[58] Field of Search ..... 52/378, 726, 583, 587; 411/411; 403/343, 300; 404/62, 61, 59, 56

[56] References Cited

U.S. PATENT DOCUMENTS

| | | | |
|---|---|---|---|
| 2,127,973 | 8/1938 | Isett | 404/56 |
| 2,187,912 | 1/1940 | Peirce | 404/56 |
| 3,260,175 | 7/1966 | Crone | 404/61 |
| 4,095,389 | 6/1978 | Outram et al. | 52/726 X |
| 4,143,986 | 3/1979 | Antosh | 52/726 X |

OTHER PUBLICATIONS

*Manual of Standard Practice,* Concrete Reinforcing Steel Institute, Jan. 1980.

*Primary Examiner*—Carl D. Friedman

*Attorney, Agent, or Firm*—Ralf H. Siegemund

[57] ABSTRACT

Rebars to be embedded in a monolithic concrete structure are spliced together; also deformed rebars are spliced together across an expansion joint or construction joint between two or more monolithic concrete pours in that one rebar is provided with a threaded receiver barrel, possibly having a flange, and into which is introduced the, preferably, expanded and threaded end of the other rebar; no third splicing element is involved. Short rebars with a receiver at one end can also serve for defining anchor points in the outer surface of a concrete structure.

8 Claims, 8 Drawing Figures

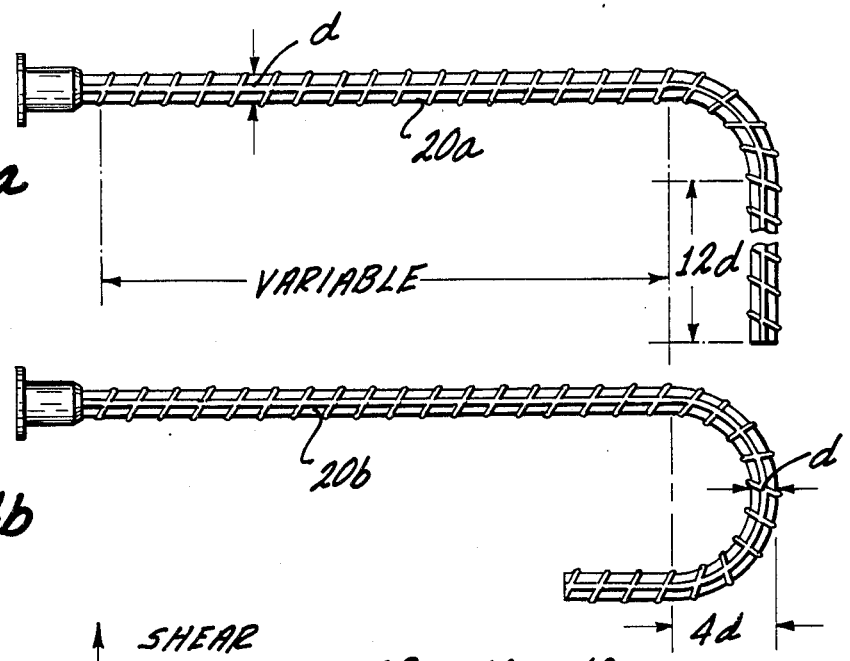
FIG. 4a
FIG. 4b
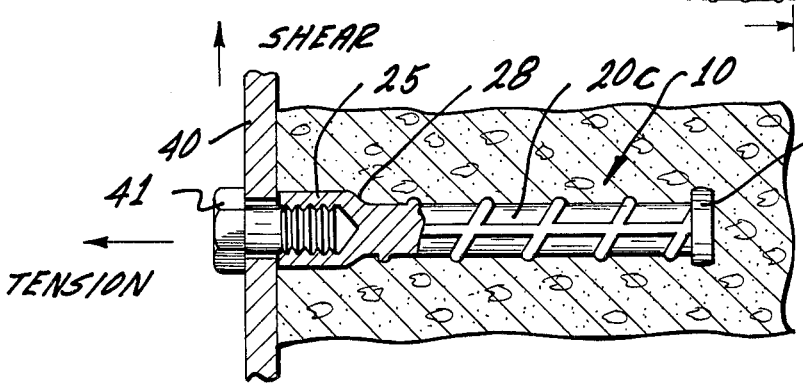
FIG. 4c
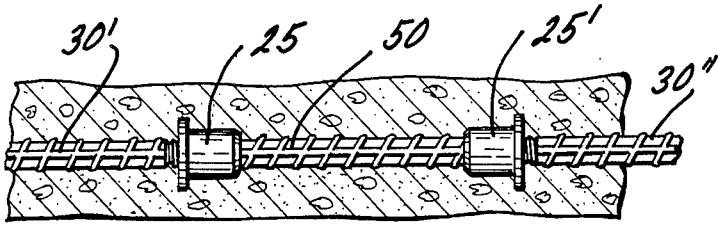
FIG. 5a
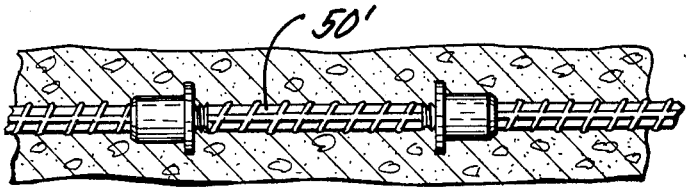
FIG. 5b

REBAR SPLICING AND ANCHORING

BACKGROUND OF THE INVENTION

The present invention relates to rebar splicing and anchoring. A rebar, in conventional parlance, is a rod which has ribs for impeding turning as well as axial displacement when embedded in concrete. For example, such a rebar has annular, spaced-apart, continuous ribs as well as at least one, preferably two, continuous, axial ribs. Alternatively, helical or oblique annular ribs are used to impede turning as well as axial pullout. A good summary for rebars is published, e.g., on pages A 1 through A 5 in the Appendix to the "MANUAL OF STANDARD PRACTICE," by the Concrete Reinforcing Steel Institute (January 1980). These rebars are made of steel and are used as reinforcing elements in concrete structures. Occasionally, the need arises for splicing two such rebars together. This will be particularly the case when concrete formwork is massive or is carried out in steps or stages, and the reinforcing, continuous bars between different parts of the concrete structure.

Known splicing devices include one or more joining elements, such as a coupler, which are respectively connected to both elements to be spliced. While satisfactory, as far as performance is concerned, these splicing constructions are impractical because, in the rough environment of concrete formwork, they can easily be lost, damaged, or soiled (so that they need to be cleaned). Also in some instances, they are difficult to handle, particularly for workmen using bulky gloves in cold weather.

DESCRIPTION OF THE INVENTION

It is an object of the present invention to improve rebar-splicing structures, involving rebars as defined above and as used for and in concrete formwork.

It is a further object of the present invention to provide new rebar construction features for use within concrete formwork.

In accordance with the preferred embodiment of the present invention, it is suggested to provide the end of a first rebar, having ribs along its surface for impeding axial pullout as well as turning when embedded with a receiver head or barrel having a threaded bore. That receiver barrel is preferably integral with the respective rebar end which has been worked (forged) out of the rebar end, or (but not preferred) has been welded thereto. A threaded male end of a second, similar rebar is threaded into that receiver for effecting the splice. This male thread could be simply cut into the rebar end; but it is preferred to first enlarge (forge) that end in order to obtain a larger diameter end portion and to roll the thread into that enlarged end portion.

It can thus be seen that there are no additional splicing elements involved; the parts to be spliced include all that is needed for the splicing. Moreover, either rebar can be embedded first in concrete; and one can splice thereto another rebar by simply threading the respective receiver barrel onto the respective threaded end of the other rebar. However, the spliced rebars may be embedded in one monolithic pour. Short rebars with receivers may be provided at their respective other ends with bent-off portions or a bolt head or another receiver because the ribs of the rebar may be insufficient to resist pullout and/or turning in the concrete. Such a short rebar may also be used to establish an anchor point in an outside surface of the concrete.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

FIGS. 4*a*, 4*b*, and 4*c* are views of three examples for differently contoured rebars with receivers for purposes of splicing and/or establishing anchor points; and FIGS. 5*a* and 5*b* are sections through splicing elements in accordance with the preferred embodiment.

Proceeding now to the detailed description of the drawings, FIG. 1 illustrates a first concrete wall 10, having an external surface 11. The figure is used as a composite to show various examples.

Figure 1:
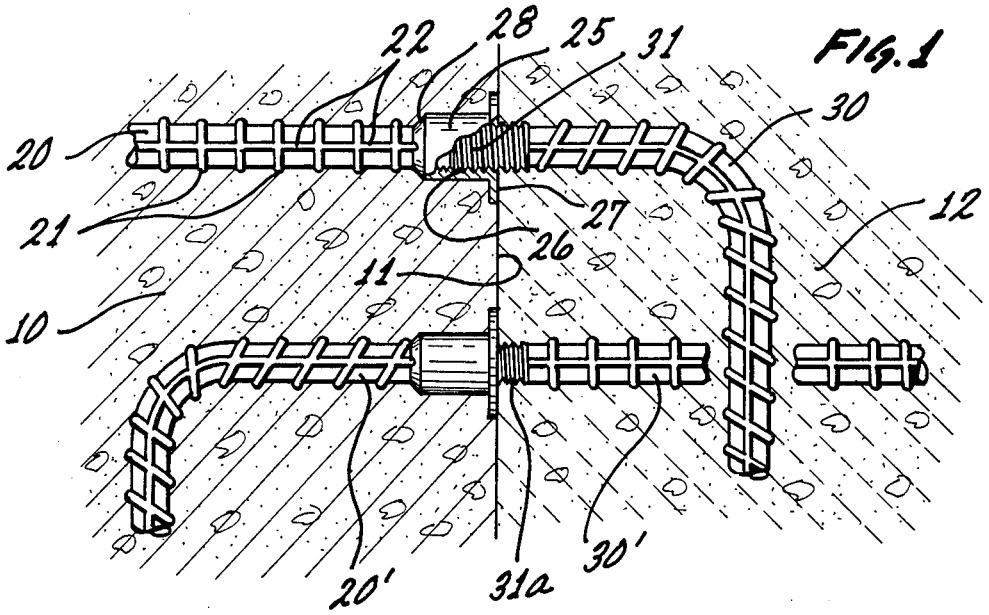
FIG. 1 is a section view through a concrete wall structure, showing two splices in accordance with the preferred embodiment of the invention for practicing the best mode thereof.

A rebar 20 is embedded in the concrete and extends therein at a length as required; at the very least, its length is one (or more) orders of magnitude its diameter. The rebar has the usual peripheral, spaced-apart ribs 21 and a longitudinal rib 22. The front end of the rebar is provided with a receiver head 25. The head has a larger diameter than the rebar.

The receiver 25 should be made an integral part of the rebar, e.g., by forging the rebar's end into a cylindrically shaped or a hexa-shaped configuration. Alternatively, the receiver could be a separate element that has been flashwelded to the rebar; but an integral construction is preferred.

The transition from stem to receiver is provided with a taper 28 which facilitates manufacturing these parts as an integral piece. The taper is of frustoconical configuration, and the apex angle of that cone should not exceed approximately 60°. Observing this limit will ensure that the taper can serve as a load-bearing shoulder; a shallower apex angle is more difficult to manufacture and would, most importantly, establish too abrupt a transition between receiver and rebar. This aspect is important with regard to a distribution of forces from receiver 25 into rebar 20.

The receiver 25 has a threaded bore 26, leaving, however, a calculated minimum wall thickness so that an inserted, threaded element can transmit evenly shear, tension, and bending forces to the receiver; the taper 28 avoids an abrupt transition into the stem so that these forces will be smoothly distributed into the stem for, ultimately, the reaction into the surrounding concrete.

Figure 2:
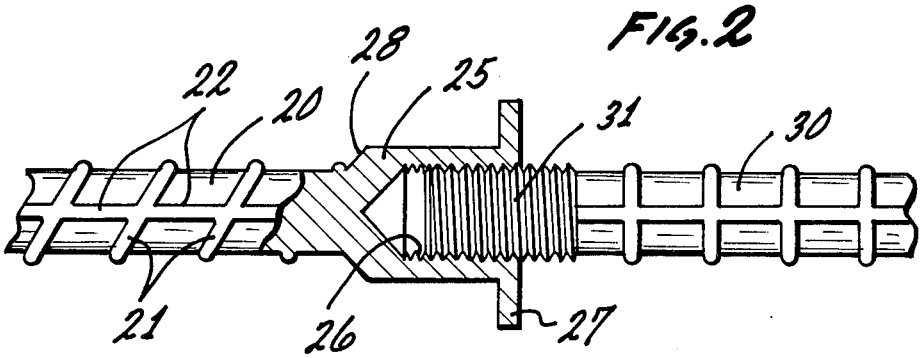
FIG. 2 is an enlarged view of a detail.

The function of receiver 25 is to receive the threaded end 31 of a second rebar 30, also called dowel-in. The rebar, in this case, has a 90° bend for reasons of its specific, intended application. Rather important, however, is the threaded configuration of that rebar, as can be better derived from FIG. 2. The rebar 30 was originally a regular one having the particular (or any other) rib pattern illustrated. The one end of that rebar-has been blown up (e.g., enlarged by upset forging) in order to assume a larger diameter. Next, that larger diameter portion is rolled for obtaining the male thread. One could machine the thread into this enlarged diameter rebar end portion; but rolling is preferred because the groove's ridge pattern results from a flow of material and not by cutting into the grain's texture which weakens the structure. The diameter of the smallest thread (i.e., the diameter of the bottom of the helical groove) is not smaller than the original diameter of the rebar, the ridge being accordingly larger. Thus, the formation of the male thread at the rebar end does not reduce the strength of that end portion. Formation of the thread should generally not have a weakening effect. For this reason, one should not just roll or even cut (machine) the thread into the rebar end unless, of course, for some reason the resulting weakening of the bar end can be tolerated. The thread 31*a* in FIG. 1 has just been cut into the rebar 30. The lower portion of FIG. 1 illustrates a further modification as far as the rebar's contour is concerned. The rebar, 20′, having a receiver 25, is bent, whereas the other rebar, 30′, being spliced to rebar 20′, is straight.

As indicated by the dotted lines, a second concrete wall portion 12 will be made later by pouring concrete into a suitable form, usually made of wood. The wall or slab 10 has been made in like manner, but wall or slab 12 is made later; and the joint constitutes a splice between two rebars, 20 and 30, which, in turn, constitute a part of the reinforcing structure for these walls, slabs, or the like.

It can readily be seen that it is a matter of convenience which one of the two elements, 20 or 30, are embedded first. The rebar with a threaded end, e.g., element 30, could well be anchored into concrete first; and the threaded end projects from the surface of the resulting wall or slab; but that is not the preferred way. However, in a large, spliced-together rebar network of and for complex formwork, it may well happen that this inverse order and relationship must be accommodated, which does not pose any problems. In this case, the matching receiver head, e.g. head 25, is threaded onto threaded end 31 of an embedded rebar, whereupon the other wall portion is made, so to speak, around that rebar 20 and its receiver head 25.

It should be mentioned, however, that the inventive rebar splicing is not restricted to a sequence of formworking and concrete-pouring steps. The splice can also be used in the regular fashion in a rebar cage, e.g., for splicing rebars together. The rebars with a splice will subsequently be embedded in concrete, in a monolithic pour. This aspect points toward a general feature of the invention, namely that rebars generally could or even should be provided with receivers and/or male threads at both ends, to better construct self-supporting rebar cages. The choice is dictated primarily by the dimensions, and so forth, of the concrete's formwork to be reinforced. In either case, one can readily see that the rather simple splicing structure continues the rebar's network of one concrete structure element into the adjoining one.

It is significant, as demonstrated in the various examples, that the splice is not only integral with the parts being spliced; but the splice also ensures that the rebars are directly axially aligned to each other as, moreover, the two rebars are firmly threaded to each other. Later on, each rebar is held by its longitudinal rib against any torque, which the one being freshly embedded may-exert upon the other as, for example, during pouring of the concrete or for any other reason. Also, forces are transmitted from one rebar to the next, in that each one serves as a direct, linear extension of the respective other one. Forces are not transmitted via any additional (third) splicing element or assembly.

Figure 3:
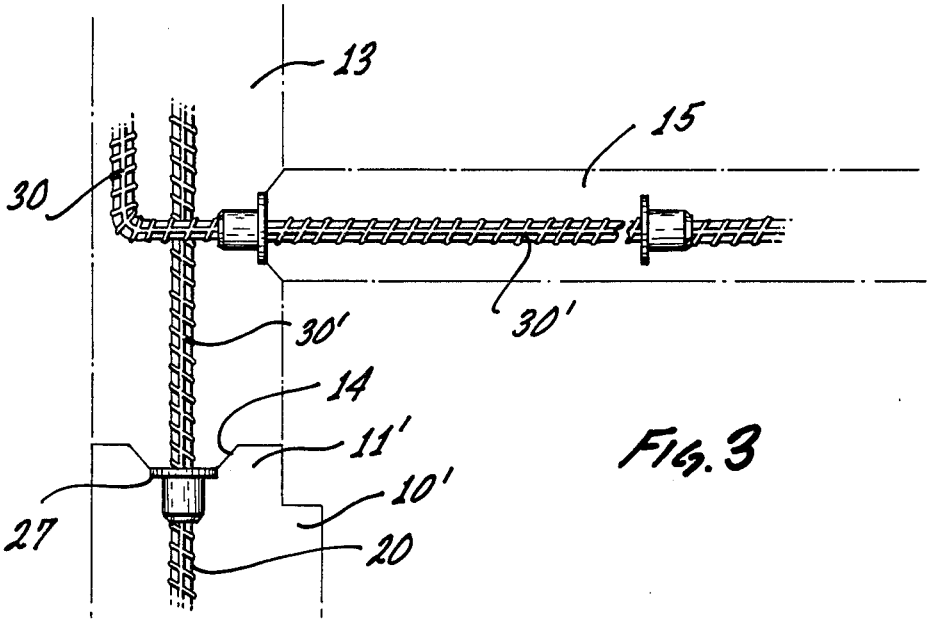
FIG. 3 is a section view through a composite wall structure having embedded within differently contoured rebars, but all with the same splices.

FIG. 3 illustrates, by way of example, a composite rebar and splice construction in two levels, involving three concrete form and structure elements. The figure illustrates generally the use of bent as well as straight rebars. In this particular configuration, an end wall 10′ has a front end 11′ to which another wall 13 of a thinner dimension is to be added. The particular rebar 20, as embedded, has its flange 27 flush with the bottom of a keyway 14 in that end surface. A straight rebar 30′ with its male thread head extends also straight into the wall extension 13, which is to be made. A concrete cross-wall 15 is still to be made subsequently, and another straight rebar with a male head 30*a*′ but with a receiver at the other end will be embedded therein. The male head of rebar 30*a*′ has been threaded in the receiver head of a bent rebar 30 which is located in a plane, different from the plane of rebars 20 and 30, but in the same concrete formwork, wall extension 13.

FIGS. 4*a*, 4*b*, and 4*c* illustrate, respectively, three examples for short rebars 20*a*, 20*b*, and 20*c*, each one having receiver heads and serving as an embed and anchor point. In particular, the length of these rebars is insufficient for adequately resisting pullout by means of their ribs alone. Thus, rebar 20*a* has its end bent for obtaining an L-shaped configuration whereas rebar 20*b* is bent to resemble a "J". The FIGS. 4*a* and 4*b* show particularly geometric features, relating the rebar diameter d to dimensions. The diameter of the curved rebar portion could also be 5*d* or 6*d*. FIG. 4*c*illustrates a further configuration in which the rebar 20*c* has a bolt head 23 at the end opposite receiver 25. The bolt head augments significantly the pull-out strength of this imbedded rebar. Preferably, the bolt head 23 is of a hexa-configuration so that it contributes also to the prevention of turning of the rebar when embedded.

These rebar imbeds are particularly useful in limited space envelops. However, FIG. 4*c* illustrates a still further application. In particular, FIG. 4*c* illustrates how the rebar can be used to establish a fixed or elastic support point for a plate 40. The plate plate 40 will be clamped between the shoulder of the receiver 25 and a head of a bolt 41 being threaded into the receiver of the rebar 20*c*. The plate 40 is clamped into the receiver of the rebar 20*c*. The plate 40 is clamped directly against the concrete, so that the anchor becomes fully effective in resisting plate bending. The headed bolt could be replaced by a threaded stud and nut combination or by a rebar with a male thread and a nut. The receiver 25 could be welded to the plate 40, but the bolt or stud will still be inserted and a bolt head or nut be clamped against the plate. In either case, a washer may be interposed between the bolt head and plate 40 to widen the effective diameter of the interface between plate 40 and the bolt head.

Shear forces are reacted by the bolt into the receiver 25 which distributes the force directly into the surrounding concrete. These forces are components of tension and shear usually induced by "heel-toe" action. These forces are transmitted through the respective rebar 20*c* and receiver 25.

Any tension on a threaded-in stud or on the bolt 41 is directly effective on the inserted rebar, and is distributed as a bond force along the rebar 20*c* and as reaction against displacement of the base 23, by the effect of stress cone distribution. Such tension on the bolt 41 can arise when a load is applied to the plate, and another anchor point acts as a fulcrum so that the bending moment on the plate tends to pull the assembly 41-20*c* out of the concrete. Firm, threaded engagement by the bolt in receiver 25 assures that the tension force is distributed upon the insert as a whole so that only very minimal reaction occurs between the receiver and surface-near portions of the concrete.

Any bending forces in the plate 40 are counteracted by the bolt head 41 as clamping plate 40 against the concrete surface. This feature establishes an elastic joint or support point for the plate, thereby reducing bending stresses through moment redistribution by taking advantage of the fact that this particular type of joint modifies the boundary conditions for the resilient reaction of the assembly as a whole against any bending moment exerted by the plate upon any structure to which it is connected. That modification produces a more elastic reaction of the joint as such, as compared with a stud just being welded onto the backside of the plate. The adjustable clamping action by the nut is instrumental in introducing a ductility in this support joint, permitting plate bending as a whole to be attenuated by transmission of tension compression into the embed and the concrete. Upon inserting a washer between the head of bolt 41 and plate 40 (or upon using a bolt with a wider diameter head), one obtains greater point fixity and stiffens the support point further with regard to bending moments in plate 40. It should be realized that the rebar configuration shown in FIGS. 4*a* and 4*b* can be used in the same fashion.

FIG. 4*c* also demonstrates how the embedded rebar can be preloaded in respect to stress. Upon continued tightening of the bolt, the head of bolt 41 bears against plate 40; and a force is exerted against the embedded rebar in longitudinal or axial direction, tending to pull the rebar out of the concrete. The bond of the stem to the concrete and, primarily, the embedded base 23 resist that pull so that the embed is longitudinally tensioned, i.e., tension preloaded. The nonround portion will positively resist turning of the embed. If the bolt is replaced by a stud with a threaded-on lock nut, further tightening of the nut will not exert any torque upon such a stud so that the resulting preloading of the embed is strictly the result of axial tension.

In addition, the concrete surrounding the embbeded rebar is likewise preloaded. As the head of bolt 41 is urged toward plate 40, compression is exerted upon the adjoining concrete as sandwiched between plate 40 and base 23, the latter being urged in direction toward the exterior of the concrete. The base acts directly in line with that compressive force from plate 40 so that, indeed, the concrete adjacent to the rebar 20*c* and the receiver 25 is placed under compressive stress.

The preloading adjusts the support point fixity. Tension-compression stress acting on the bolt and the resiliency of the reaction of these forces into the concrete are affected by such preloading. Generally speaking, preloading the embedded rebar changes the effective elasticity and resilient reaction of the joint; it becomes stiffer. Preloading the concrete modifies the resilient interaction between embed and concrete and introduces friction-resistance capacities of the joint. The point fixity in regard to bending moments is further adjustable by interposing a washer between the bolt head and the plate.

It should be noted that this preloading is effective only when the receiver is recessed from the surface of the concrete. If the front end of the receiver is flush with the concrete or even projects a little from the surface of the concrete, only the bolt will be preloaded. Still alternatively, however, the aperture in plate 40 may have a larger diameter than the outer diameter of the receiver. In this case, preloading is not depending upon the extent of recession or projection of the embedded rebar. However, it may well be necessary in this case to interpose a washer between the head of bolt 40 and plate 40 in order to increase the area of contact.

In lieu of a bolt, a long bolt, or even a stud which may be quite long, may be threaded into the receiver, and a nut of the lock nut type is threaded onto that bolt or stud, thereby exerting a clamping force upon any surface against which it will bear. Irrespective of this aspect, any bending forces are reacted upon in the same manner as previously discussed. Direct bending of such a stud, 20, will be reacted upon the concrete only to the extent that the insert will yield.

FIG. 4*c* may be modified to allow the plate 40 to stay directly in contact with the shoulder of the receiver. The embed will be flush with, or will even project from, the concrete surface in that case. Tightening the bolt will, in this instance, preload the bolt only, with no stiffening of the concrete or plate; and one does not induce a friction load capacity.

In the several examples above, a structure is shown which, in effect, will result (as to the concrete) in improved, integral rebar splices. The splice proper consists of the receiver head at the end of one rebar and of a male thread at the end of a second rebar. FIGS. 5*a*, 5*b* and 5*c* extend the inventive concept further, particularly for monolithic pours. FIG. 5*a* illustrates two, possibly straight and rather long, rebars 30′ and 30″, each one constructed as a dowel-in element, i.e., each having a male thread end. These two rebars are, therefore, incompatible for direct splicing. The particular splicing element 50, however, does permit their interconnection. The element has two receiver heads 25 and 25′ for threadedly receiving the dowel-in portions of rebars 30′ and 30″. It can readily be seen that one may have a plurality of such elements available, possibly in different lengths, and basically just for such an "emergency" situation when rebars to be spliced do not have mating ends. Analogously, FIG. 5*b* illustrates a short splicing element 50′ which has two male thread ends for dowel-in elements, permitting two rebar ends with receivers to be interconnected.

The element 50 could also be used as a double-receiver embed for various purposes, as explained in the reference to FIG. 4*c*, such as anchoring of one end, or both ends, to a bar, a plate, or the like. Also, such short elements, 50 or 50′, may find utility in cases of running rebars transversely through a concrete wall which has been poured first; and later, long rebars are to be connected thereto, pursuant to subsequent pours, e.g., of a concrete wall structure extending at right angles to the one poured first.

The invention is not limited to the embodiments described above; but all changes and modifications thereof, not constituting departures from the spirit and scope of the invention, are intended to be included.

I claim:

1. A rebar splice, for splicing two rebars, both of which are embedded in concrete, each being a long bar having rib means for impeding turning in and pull-out from the concrete, the splice comprising:

a receiver head unitary with (secured) to one end of one of the rebars, having a threaded bore and an end face whose external surface is flush with an external, temporary concrete surface;

a threaded male head integral with and at one end of the other rebar and being inserted into and threadedly received directly by the receiver, and to be embedded in concrete, except for the threaded head, and said rebars having embedded in different concrete structure portions which have been made at different times so that a first one of the rebars has been embedded first in one of the concrete structure portions, a respective second rebar having been threaded to the first one rebar prior to also being embedded in the other one of the concrete structure portions.

2. A rebar splice for splicing two rebars, the two rebars respectively having first and second ends being spaced apart, comprising:

a splicing element being a short rebar, each of said rebars having rib means for impeding turning and pull-out from the concrete, the element having respectively third and fourth ends;

the element being disposed so that said first end faces said third end, and the second end faces the fourth end;

one of the first and third ends and one of the second and fourth ends being respectively constructed as an unitary receiver of wider diameter than the respective rebar and having a threaded bore;

the respective other one of the first and third ends and the respective other one of the second and fourth ends respectively constructed as an integral a male thread having a larger diameter than the remainder of the rebars, said male threads being threadedly inserted directly in the respective adjacent receiver; and said rebars being embedded in concrete.

3. A rebar splice for splicing two rebars, both of which being embedded in concrete, each being a long rebard having rib means for impeding turning in and pull-out from the concrete, the splice comprising:

a receiver head unitary with (secured) to one end of one of the rebars, having a larger diameter than the rebar and having a threaded bore and an end face; and a threaded male head integral with and at one end of the other rebar and being inserted into and directly threadedly received by the receiver.

4. A rebar splice as in claim 1, 2, or 3, at least one of the rebars being bent.

5. A rebar splice as in claim 1, 2, or 3, wherein the one or at least one of the male threads is provided in an end portion of the respective rebar, having a larger diameter than the remainder of the rebar.

6. A rebar splice as in claim 5, said one male thread having been rolled so that its grain texture is not cut.

7. A rebar splice as in claim 1, 2, or 3 wherein the receiver is provided with a flange.

8. A fastening assembly, comprising:

a first rebar for anchoring in concrete, being made of steel and having a rib means to resist pull-out and turning, further having an unitary receiver element extending from the rebar at one end thereof, and having a threaded bore not extending into the rebar, the receiver further having a larger outer diameter than the rebar, said rebar being axially considerably longer than the receiver; and a second rebar, also made of steel, and being anchored in the concrete, axially aligned with said receiver, the second rebar having rib means to resist turning and pull-out, the second rebar having a threaded end, threaded end, threaded into the bore.

* * * * *